US006219000B1

(12) United States Patent
McWhirter et al.

(10) Patent No.: US 6,219,000 B1
(45) Date of Patent: Apr. 17, 2001

(54) FLARED-NOTCH RADIATOR WITH IMPROVED CROSS-POLARIZATION ABSORPTION CHARACTERISTICS

(75) Inventors: Brian T. McWhirter, Redondo Beach; Steve K. Panaretos, Los Angeles, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/371,743

(22) Filed: Aug. 10, 1999

(51) Int. Cl.[7] ..... H01Q 13/10
(52) U.S. Cl. ..... 343/767; 343/770
(58) Field of Search ..... 343/767, 770, 343/746, 703

(56) References Cited

U.S. PATENT DOCUMENTS 5,187,489 * 2/1993 Whelan et al. ..... 343/767
5,264,860 * 11/1993 Quan ..... 343/767
5,461,392 * 10/1995 Mott et al. ..... 343/767
5,502,372 * 3/1996 Quan ..... 324/72.5
5,557,291 * 9/1996 Chu et al. ..... 343/770
5,638,033 * 6/1997 Walker et al. ..... 343/767
5,659,326 8/1997 McWhirter et al. ..... 343/770
5,703,599 * 12/1997 Quan et al. ..... 342/368
5,982,338 * 11/1999 Wong ..... 343/853

* cited by examiner

*Primary Examiner*—Hoanganh Le
*Assistant Examiner*—Thuy Vinh Tran
(74) *Attorney, Agent, or Firm*—Leonard A. Alkov; Glenn H. Lenzen, Jr.

(57) ABSTRACT

A flared-notch radiating element has a body portion tapering to an element tip region, the radiating element having a first thickness through a body element portion. The element tip region has reduced thickness in relation to he first thickness, the reduced thickness improving absorption of the cross-polarized component of an incident wave. The reduced thickness of the tip region can be provided by a single step reduction in the element thickness, by multiple stepped reductions in thickness, or by tapering the thickness from the thickness of the element body portion to an end tip thickness.

13 Claims, 4 Drawing Sheets

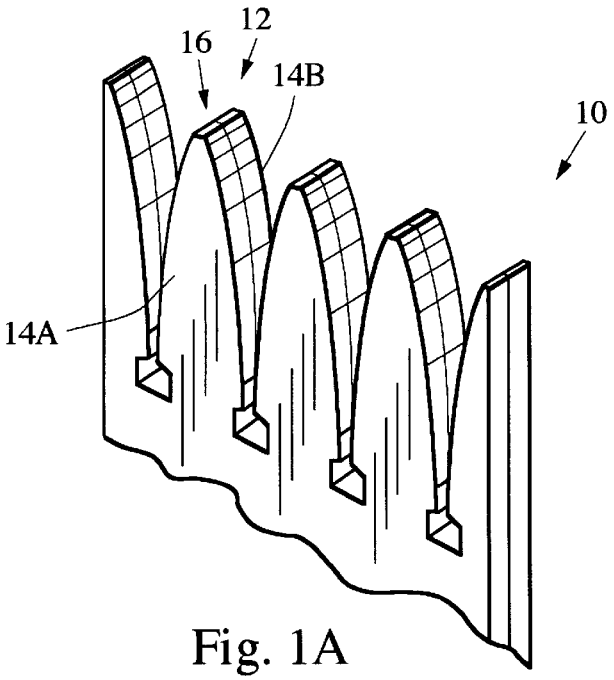
Fig. 1A
( Prior Art )
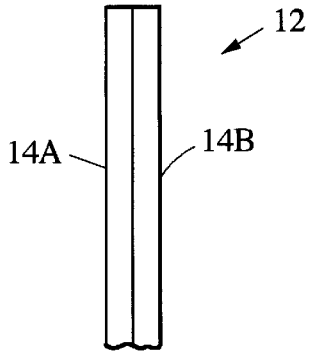
Fig. 1B
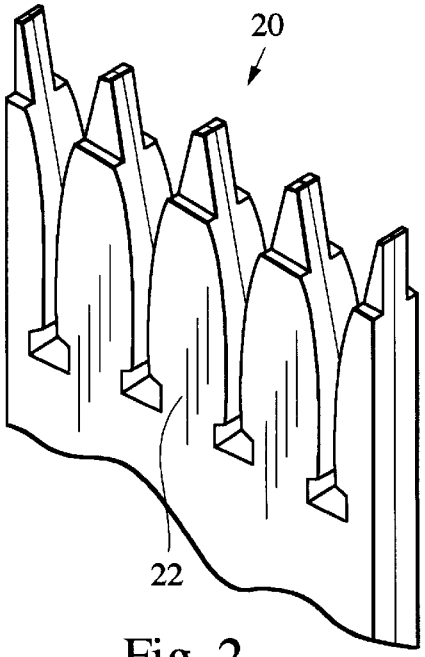
Fig. 2
Fig. 3C
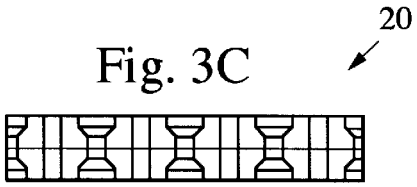
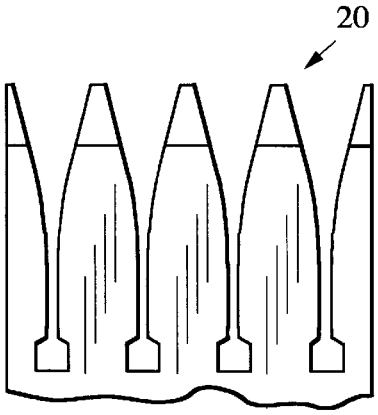
Fig. 3A
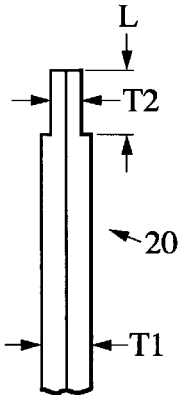
Fig. 3B

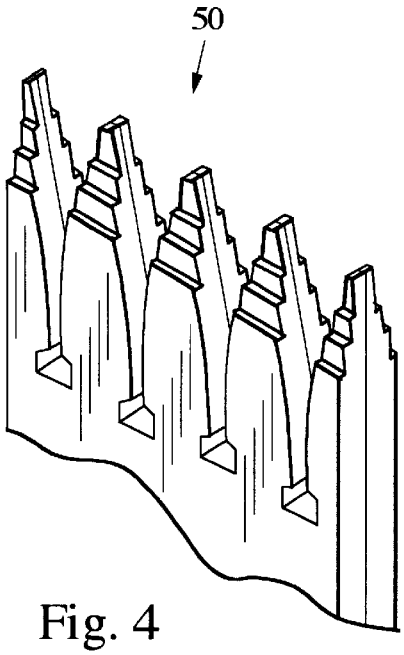
Fig. 4
Fig. 5C
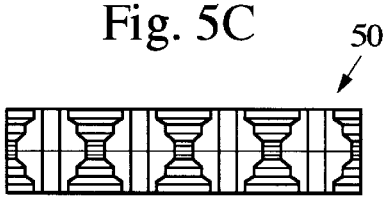
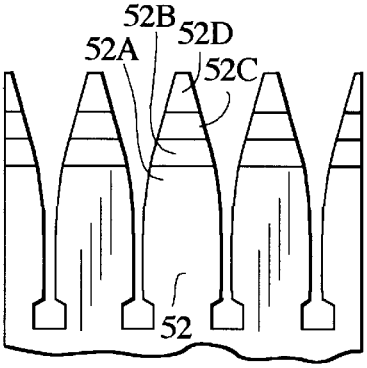
Fig. 5A
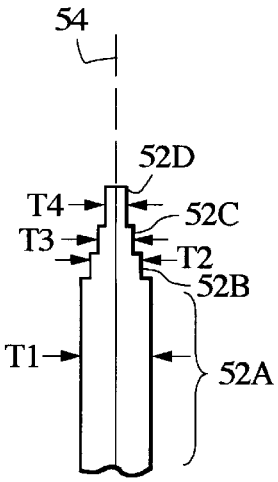
Fig. 5B
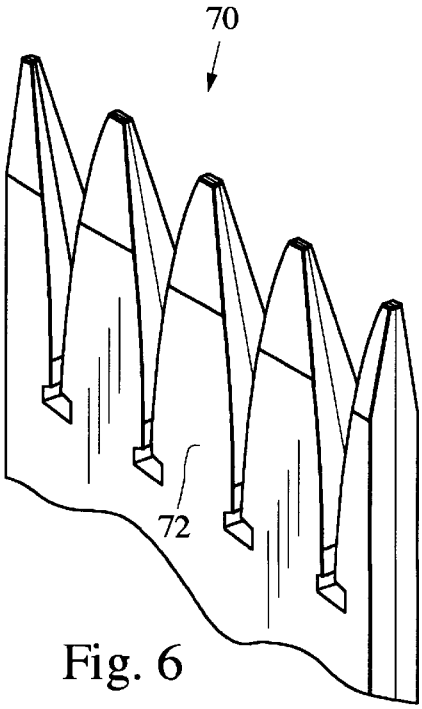
Fig. 6
Fig. 7C
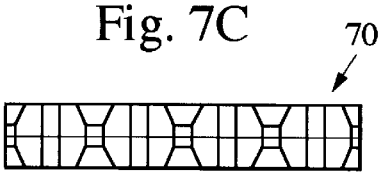
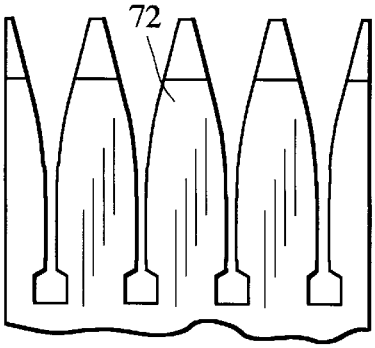
Fig. 7A
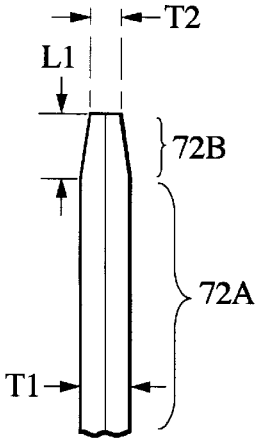
Fig. 7B

FLARED-NOTCH RADIATOR WITH IMPROVED CROSS-POLARIZATION ABSORPTION CHARACTERISTICS

TECHNICAL FIELD OF THE INVENTION

This invention relates to antenna elements for radar arrays, and more particularly to a flared-notch radiator having a reduced aperture return loss to cross-polarized incident plane waves.

BACKGROUND OF THE INVENTION

Single-polarization, flared-notch radiators are typically designed by optimizing the radiation performance of the element in one plane (co-polarized), without regard to its performance characteristics in the plane orthogonal to the radiator (cross-polarized). For a wave impinging upon an antenna comprised of these flared-notch radiators, this design approach results in a radiator that provides maximum absorption of the co-polarized component of the incident wave, but minimal absorption of the cross-polarized component from the radiator tips.

It would therefore be an advantage to provide a technique to improve this cross-polarization absorption component.

SUMMARY OF THE INVENTION

A flared-notch radiating element in accordance with the invention has a body portion tapering to an element tip region, the radiating element having a first thickness through a body element portion. The element tip region has reduced thickness in relation to the first thickness, the reduced thickness improving the absorption of the cross-polarized component of an incident wave.

The reduced thickness of the tip region can be provided in several ways. For example, there can be a single step reduction in the element thickness, or the tip region can have multiple stepped reductions in thickness. Another alternative is to smoothly taper the thickness from the thickness of the element body portion to an end tip thickness.

A typical application for a flared-notch radiator in accordance with the invention is in an array of flared-notch radiator elements. The array includes typically a plurality of metal sticks disposed in aligned rows, each stick defining a plurality of flared notches, with adjacent ones of the metal sticks being separated by a separation distance so as to define a respective channel between each adjacent pair of sticks. The co-polarized component of the incident wave is parallel to the channels, and the cross-polarized component is transverse to the channels. Thus, the thickness dimension being reduced in accordance with the invention is the dimension transverse to the channels between the array sticks.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1A is an isometric view of a portion of a conventional single-polarization, flared-notch radiator stick.

FIG. 1B is an end view of the radiator stick of FIG. 1A.

FIG. 2 is an isometric view of a first embodiment of a flared-notch radiator in accordance with the invention.

FIGS. 3A, 3B and 3C are respectively side, end and top views of the flared-notch radiator of FIG. 2.

FIG. 4 is an isometric view of a second embodiment of a flared-notch radiator in accordance with the invention.

FIGS. 5A, 5B and 5C are respectively side, end and top views of the flared-notch radiator of FIG. 4.

FIG. 6 is an isometric view of a third embodiment of a flared-notch radiator in accordance with the invention.

FIGS. 7A, 7B and 7C are respectively side, end and top views of the flared-notch radiator of FIG. 6.

DETAILED DESCRIPTION OF THE PREFERRED EMBODIMENT

FIG. 1A shows a portion of a conventional flared-notch radiator stick, 10, comprising a plurality of flared-notch radiator elements. An antenna array will typically include a number of the sticks arranged in parallel. An exemplary array is illustrated in U.S. Pat. No. 5,659,326, the entire contents of which are incorporated herein by this reference. The radiating elements such as element 12 include conductive body structures 14A, 14B that taper to a tip 16. As shown in the end view of FIG. 1B, however, the conductive body structures 14A, 14B are of uniform thickness. While two body structures 14A, 14B are illustrated, and typically sandwich a balun circuit (not shown), the radiating element could be fabricated of one body structure or more than two body structures. This is true as well for radiating elements embodying this invention.

FIG. 2 is an isometric view of a portion of a flared-notch radiator stick 20 embodying a first embodiment of a flared-notch radiator element in accordance with this invention. FIGS. 3A–3C further illustrate the stick 20 in respective side, end and top views. As illustrated therein, the radiating elements 22 of the stick 20 have a tip region of reduced thickness, to act as an impedance transformer for the cross-polarization component of an impinging wave as it transitions from free space to the parallel-plate region between the flared-notch radiator sticks of an antenna. Thus, as shown in FIG. 3B, the radiating elements of the stick 20 have a thickness T1 at the balun region, and a reduced thickness T2 at the tip. The region of reduced thickness has a length L. In this embodiment, there is a sharp thickness transition between the tip region of reduced thickness and the body region of the radiating element. In an exemplary embodiment, T1 is 0.400 inch, T2 is 0.300 inch, and L is 0.800 inch, and the radiating elements operate over a frequency range of 2 Ghz to 18 Ghz.

Figure 9:
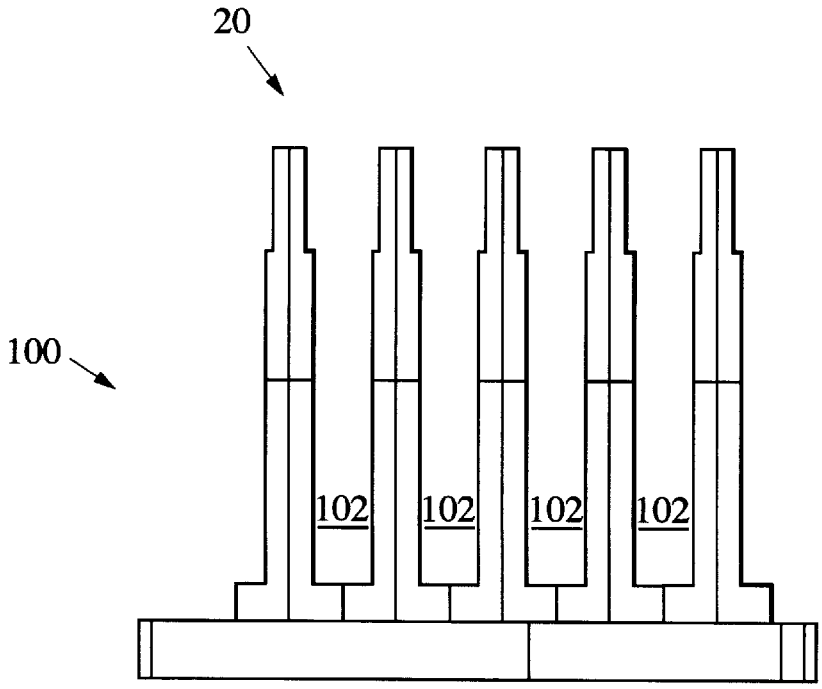
FIG. 9 is an end view of an array of sticks of the flared-notch radiator of FIG. 2.
Figure 10:
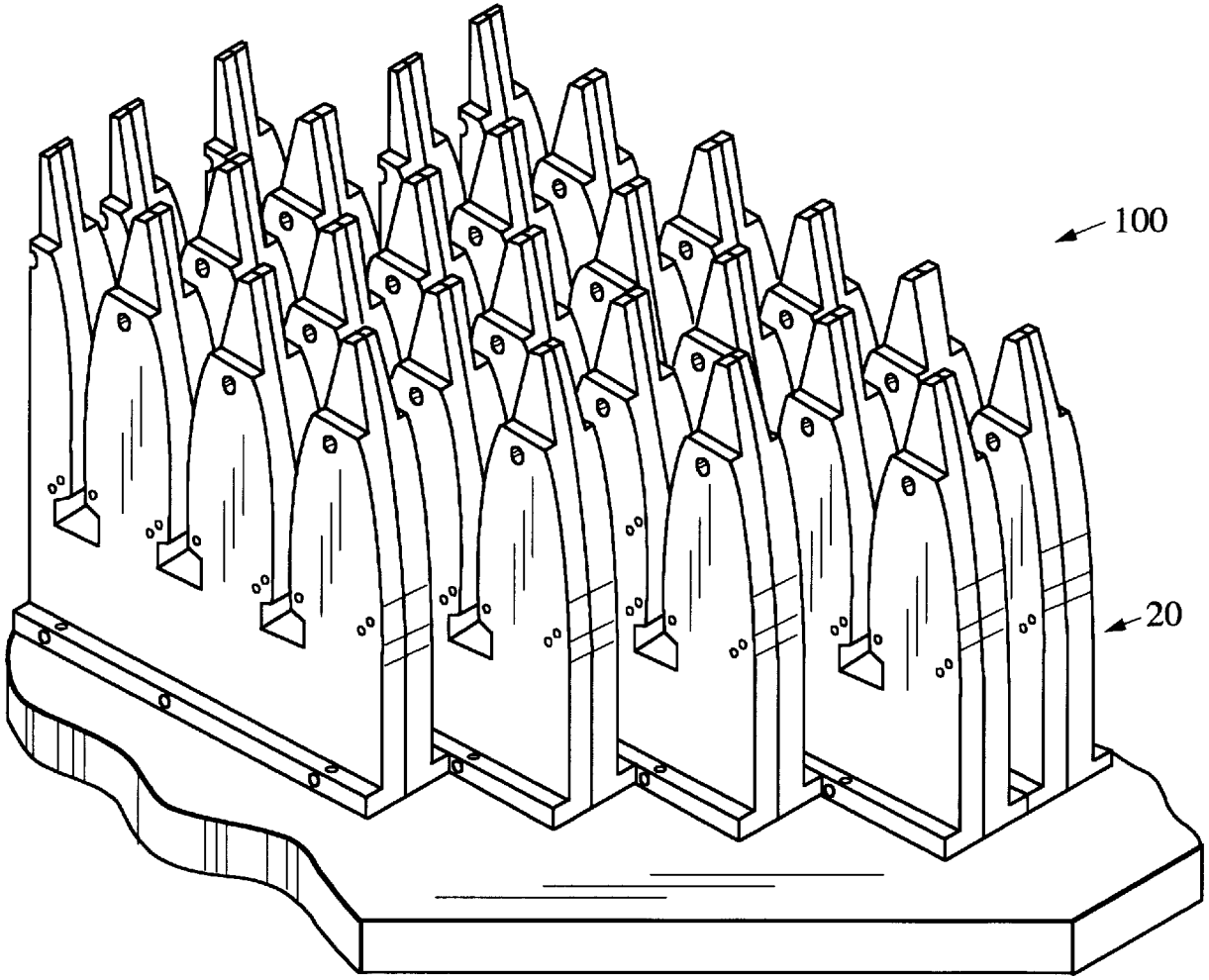
FIG. 10 is an isometric view of a portion of the array of FIG. 9.

FIGS. 9 and 10 illustrate an exemplary array 100 of the sticks 20 of the radiating elements 22. The sticks are arranged in parallel in spaced relation, defining regions 102 between adjacent sticks that can be analyzed as parallel-plate channels. In some embodiments, an optional energy absorbing material can be placed at the bottom of the regions 102, providing loading which can absorb any incident energy that is not absorbed by the radiating elements.

FIGS. 4–5 illustrate a stick 50 of radiating elements employing a second embodiment of a flared-notch radiating element in accordance with the invention. Here, the tips of the radiating elements are formed with a plurality of regions of progressively reduced thicknesses. Thus, radiating element 52 has a body region 52A of thickness T1, a first reduced thickness region 52B, a second reduced thickness region 52C, and a fourth reduced thickness region 52D. In an exemplary embodiment, T1 is 0.400 inch, T2 is 0.375 inch, T3 is 0.300 inch, T4 is 0.300 inch, and the respective regions 52B, 52C, 52D have respective lengths 0.275 inch, 0.275 inch and 0.275 inch along the longitudinal axis 54 of the radiating element 52. When the overall tapering length is short compared with the wavelength of the incident wave, a single-step or multi-step tip will provide better performance (lower return loss) over a specified frequency range than a smoothly tapered tip.

FIGS. 6–7 illustrate a stick 70 of radiating elements employing a second embodiment of a flared-notch radiating element in accordance with the invention. Here the tips of the radiating elements 72 are smoothly tapered from the thickness T1 of the body of the element to a reduced thickness T2 at the tip. The tapered region 72B has an effective length L1=1 inch, with T1=0.400 inch, and T2=0.300 inch, in an exemplary embodiment.

Figure 8:
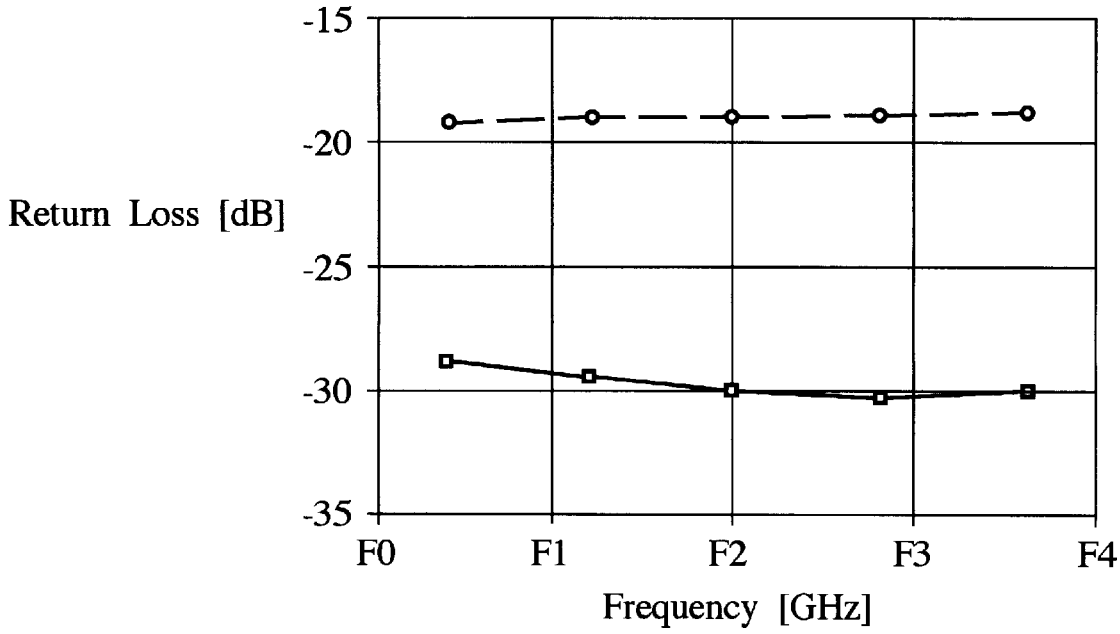
FIG. 8 is a graph plotting simulation results of the return loss versus frequency performance of a conventional flared-notch radiator and of a flared-notch radiator in accordance with the invention.

FIG. 8 illustrates results of a simulation of the return loss performance of the flared-notch radiator of FIG. 1 and that of the flared-notch radiator of FIGS. 6–7. An exemplary frequency range of operation is from 2 Ghz to 18 Ghz.

It is understood that the above-described embodiments are merely illustrative of the possible specific embodiments that may represent principles of the present invention. Other arrangements may readily be devised in accordance with these principles by those skilled in the art without departing from the scope and spirit of the invention.

What is claimed is:

1. A flared-notch radiating element having a body portion including a balun region, the body portion tapering to an element tip region, the radiating element having a first thickness at the balun region, and wherein the element tip region has reduced thickness in relation to said first thickness, said reduced thickness of said tip region improving absorption of a cross-polarized component of an incident wave.

2. The radiating element of claim 1 wherein a thickness of said radiating element transitions abruptly from said first thickness to a second thickness at an interface between said element tip region and said balun region, said second thickness smaller than said first thickness.

3. The radiating element of claim 1 wherein said element tip region comprises a plurality of tip region portions of successively reduced thicknesses.

4. The radiating element of claim 1 wherein said element tip region is smoothly tapered in thickness from the first thickness to a tip thickness.

5. The radiating element of claim 1 comprising a first conductive body structure and a second conductive body structure which are assembled together to form said body portion.

6. An array of metal flared notch radiator elements, comprising a plurality of metal sticks disposed in aligned rows, each stick defining a plurality of flared notches, adjacent ones of said metal sticks being separated by a separation distance so as to define a respective channel between each adjacent pair of sticks, and wherein each of said radiator elements has a balun region and a body portion, the body portion tapering to an element tip region, the radiating element having a first thickness through a body element portion at the balun region, and wherein the element tip region has reduced thickness in relation to said first thickness, said reduced thickness of said tip improving absorption of a cross-polarized component of an incident wave.

7. The array of claim 6 wherein a thickness of each of said radiating element transitions abruptly from said first thickness to a second thickness at an interface between said element tip region and said balun region, said second thickness smaller than said first thickness.

8. The array of claim 6 wherein said element tip region of each of said radiating elements comprises a plurality of tip region portions of successively reduced thicknesses.

9. The array of claim 6 wherein said element tip region of each of said elements is smoothly tapered in thickness from the first thickness to a tip thickness.

10. A flared-notch radiating element comprising:

a first electrically conductive body structure and a second electrically conductive body portion, said first and second body structures assembled together to form a body portion tapering to an element tip region;

said body portion having a first thickness through a body element portion at a radiating element balun region, and wherein the element tip region has reduced thickness in relation to said first thickness, said reduced thickness of said tip improving absorption of a cross-polarized component of an incident wave.

11. The radiating element of claim 10 wherein a thickness of said radiating element transitions abruptly from said first thickness to a second thickness at an interface between said element tip region and said balun region, said second thickness smaller than said first thickness.

12. The radiating element of claim 10 wherein said element tip region comprises a plurality of tip region portions of successively reduced thicknesses.

13. The radiating element of claim 10 wherein said element tip region is smoothly tapered in thickness from the first thickness to a tip thickness.

* * * * *